US008355663B2

(12) United States Patent
Kamimura

(10) Patent No.: US 8,355,663 B2
(45) Date of Patent: Jan. 15, 2013

(54) PHOTOSENSITIVE CARTRIDGE AND IMAGE FORMING APPARATUS WITH SWINGABLE CLEANING ROLLER MECHANISM

(75) Inventor: Naoya Kamimura, Ichinomiya (JP)

(73) Assignee: Brother Kogyo Kabushiki Kaisha, Aichi-ken (JP)

( * ) Notice: Subject to any disclaimer, the term of this patent is extended or adjusted under 35 U.S.C. 154(b) by 425 days.

(21) Appl. No.: 12/568,299

(22) Filed: Sep. 28, 2009

(65) Prior Publication Data

US 2010/0080635 A1 Apr. 1, 2010

(30) Foreign Application Priority Data

Sep. 29, 2008 (JP) ..... 2008-250540

(51) Int. Cl.
*G03G 21/00* (2006.01)

(52) U.S. Cl. ..... 399/345

(58) Field of Classification Search ..... 399/357, 399/345, 346, 344, 347, 353, 167, 111, 117, 399/113, 123; 101/425, 423
See application file for complete search history.

(56) References Cited

U.S. PATENT DOCUMENTS 6,484,636 B1 * 11/2002 Seefried ..... 101/425
7,024,150 B2 4/2006 Fukuta et al.
2003/0185588 A1 * 10/2003 Takami et al. ..... 399/111

FOREIGN PATENT DOCUMENTS

JP 2004-109319 4/2004

* cited by examiner

*Primary Examiner* — Walter L Lindsay, Jr.
*Assistant Examiner* — Billy J Lactaoen
(74) *Attorney, Agent, or Firm* — Scully, Scott, Murphy & Presser, PC

(57) ABSTRACT

A photosensitive cartridge includes a frame; a photosensitive drum; a drum gear; a cleaning roller; and a cleaning gear, which is provided at one end portion of the cleaning roller, which meshes with the drum gear, and which rotates integrally with the cleaning roller by a force from the drum gear. The cleaning roller is swingable around a swing axis extending parallel to a rotation axis of the cleaning roller. The swing axis is provided at a side that is opposite to the photosensitive drum with respect to a straight line extending in an input direction of a force from a tooth surface of the drum gear through a meshing position between the cleaning gear and the drum gear. The frame includes a restricting face, which extends in a direction perpendicular to the input direction, and which restricts movement of the cleaning gear in the input direction.

6 Claims, 12 Drawing Sheets

PHOTOSENSITIVE CARTRIDGE AND IMAGE FORMING APPARATUS WITH SWINGABLE CLEANING ROLLER MECHANISM

This application claims priority from Japanese Patent Application No. 2008-250540 filed on Sep. 29, 2008, the entire subject matter of which is incorporated herein by reference.

TECHNICAL FIELD

The invention relates to a photosensitive cartridge and an image forming apparatus including the photosensitive cartridge.

BACKGROUND

There has been proposed a known electrophotographic laser printer including a primary cleaning roller and a secondary cleaning roller in order to remove extraneous matter (for example, residual toner and paper dust) on a peripheral surface of a photosensitive drum. The primary cleaning roller opposes to a photosensitive drum so as to make contact with the peripheral surface of the photosensitive drum. The secondary cleaning roller opposes to the primary cleaning roller at an opposite side of the photosensitive drum with respect to the primary cleaning roller so as to make contact with a peripheral surface of the primary cleaning roller opposed thereto at an opposite side of the photosensitive drum with respect to the primary cleaning roller.

In the known electrophotographic laser printer having such a configuration, the extraneous matter on the peripheral surface of the photosensitive drum is collected onto the primary cleaning roller as a result of rotation of the photosensitive drum and the primary cleaning roller. Then, the extraneous matter collected onto the primary cleaning roller is collected from the top of the primary cleaning roller by the secondary cleaning roller.

SUMMARY

Illustrative aspects of the invention provide a photosensitive cartridge that makes a cleaning roller to uniformly contact across an axial direction thereof with a photosensitive drum and an image forming apparatus including the photosensitive cartridge.

DETAILED DESCRIPTION

General Overview

Figure 1:
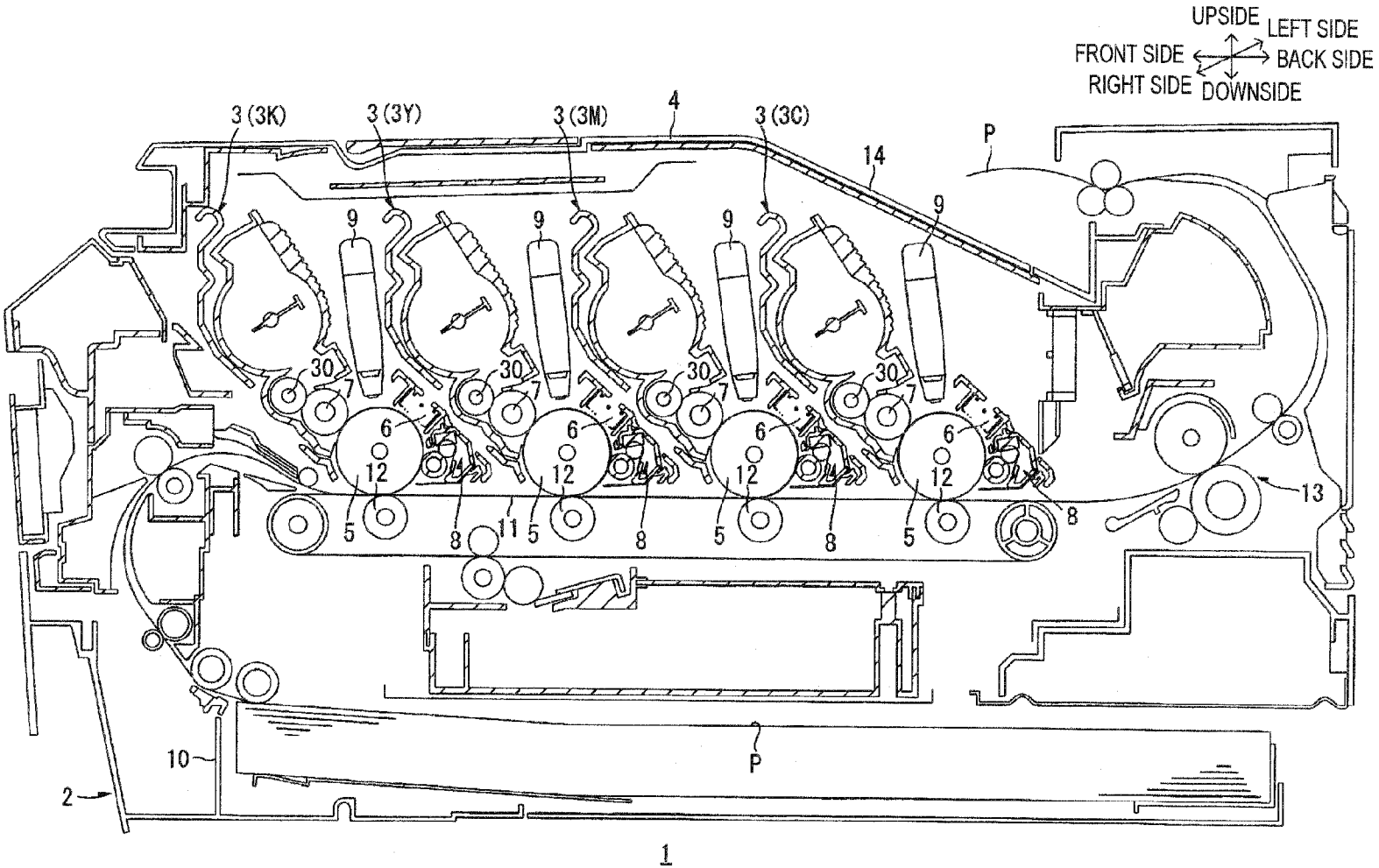
FIG. 1 is a side sectional view of an image forming apparatus according to an exemplary embodiment of the invention.

In the known electrophotographic laser printer, the primary cleaning roller is rotated so that a contact part thereof with the peripheral surface of the photosensitive drum moves in the same direction as a moving direction of the peripheral surface of the photosensitive drum. This rotation of the primary cleaning roller can be achieved by, for example, providing a drum gear at one end portion of the photosensitive drum, providing a cleaning gear to be meshed with the drum gear at one end portion of the primary cleaning roller, and transmitting a driving force from the drum gear to the cleaning gear.

However, in such a configuration, due to a force, which a tooth surface of the cleaning gear receives from a tooth surface of the drum gear, one end portion of the primary cleaning roller (end portion at the side where the cleaning gear is provided) is moved in an input direction of the force. Therefore, as a result of the primary cleaning roller not being brought into uniformly contact across an axial direction thereof with the photosensitive drum, the extraneous matter on the peripheral surface of the photosensitive drum may not be satisfactorily collected.

Therefore, illustrative aspects of the invention provide a photosensitive cartridge that makes a cleaning roller to uniformly contact across an axial direction thereof with a photosensitive drum and an image forming apparatus including the photosensitive cartridge.

According to a first illustrative aspect of the invention, there is provided a photosensitive cartridge comprising: a frame; a photosensitive drum that is rotatably supported on the frame; a drum gear, which is provided at one end portion of the photosensitive drum, and which rotates integrally with the photosensitive drum; a cleaning roller, a peripheral surface of which contacts a peripheral surface of the photosensitive drum to remove extraneous matter on the peripheral surface of the photosensitive drum; and a cleaning gear, which is provided at one end portion of the cleaning roller, which meshes with the drum gear, and which rotates integrally with the cleaning roller by a rotational driving force from the drum gear, wherein the cleaning roller is swingable around a swing axis that extends parallel to a rotation axis of the cleaning roller, wherein the swing axis is provided at a side that is opposite to the photosensitive drum with respect to a straight line, the straight line extending in an input direction of a force, which is input to a tooth surface of the cleaning gear from a tooth surface of the drum gear, through a meshing position between the cleaning gear and the drum gear, and wherein the frame comprises a restricting face, which extends in a direction perpendicular to the input direction, and which restricts movement of the cleaning gear in the input direction.

According to a second illustrative aspect of the invention, the photosensitive cartridge further comprises: a cleaning bearing member, which contacts with the restricting face, and through which an end portion of the cleaning roller is inserted in a relatively rotatable manner.

According to a third illustrative aspect of the invention, the photosensitive cartridge further comprises: a drum bearing member, which is mounted to the frame from one side, and through which an end portion of the photosensitive drum is inserted in a relatively rotatable manner, wherein the cleaning bearing member comprises: an inserting part, which is inserted from an opposite side to the one side toward the one side with respect to the frame; and an opposing part, which is bent from a front end portion of the inserting part, and which is opposed to the frame, and wherein the drum bearing member comprises an entering part that enters between the frame and the opposing part.

According to a fourth illustrative aspect of the invention, in the photosensitive cartridge, wherein a width of the cleaning bearing member is smaller than that of the restricting face in a direction along the restricting face.

According to a fifth illustrative aspect of the invention, the photosensitive cartridge further comprises: a pressing member that presses the cleaning roller toward the photosensitive drum.

According to a sixth illustrative aspect of the invention, the photosensitive cartridge further comprises: a swinging shaft, a center axis of which is the swing axis; and a pendulum bearing that integrally comprises: a swinging shaft external fitting part that is externally fitted to the swinging shaft; and a cleaning shaft external fitting part that is externally fitted to an end portion of the cleaning roller.

According to a seventh illustrative aspect of the invention, there is provided an image forming apparatus comprising a photosensitive cartridge comprising: a frame; a photosensitive drum that is rotatably supported on the frame; a drum gear, which is provided at one end portion of the photosensitive drum, and which rotates integrally with the photosensitive drum; a cleaning roller, a peripheral surface of which contacts a peripheral surface of the photosensitive drum to remove extraneous matter on the peripheral surface of the photosensitive drum; and a cleaning gear, which is provided at one end portion of the cleaning roller, which meshes with the drum gear, and which rotates integrally with the cleaning roller by a rotational driving force from the drum gear, wherein the cleaning roller is swingable around a swing axis that extends parallel to a rotation axis of the cleaning roller, wherein the swing axis is provided at a side that is opposite to the photosensitive drum with respect to a straight line, the straight line extending in an input direction of a force, which is input to a tooth surface of the cleaning gear from a tooth surface of the drum gear, through a meshing position between the cleaning gear and the drum gear, and wherein the frame comprises a restricting face, which extends in a direction perpendicular to the input direction, and which restricts movement of the cleaning gear in the input direction.

According to the first and seventh illustrative aspects of the invention, a photosensitive drum is rotatably supported on the frame of the photosensitive cartridge. A drum gear, which rotates integrally with the photosensitive drum, is provided at one end portion of the photosensitive drum. Moreover, the frame includes a cleaning roller for removing extraneous matter on the peripheral surface of the photosensitive drum. The cleaning roller is swingable around a swing axis extending parallel to a rotation axis thereof. A peripheral surface of the cleaning roller contacts the peripheral surface of the photosensitive drum. A cleaning gear is provided at one end portion of the cleaning roller. The cleaning gear meshes with the drum gear so as to rotate integrally with the cleaning roller by a rotational driving force from the drum gear. The swing axis of the cleaning roller is set at an opposite side to the photosensitive drum side with respect to a straight line extending in an input direction of a force, which a tooth surface of the cleaning gear receives from a tooth surface of the drum gear, through a meshing position between the cleaning gear and the drum gear. In addition, the frame includes a restricting face extending in a direction perpendicular to the input direction of the force, which a tooth surface of the cleaning gear receives from a tooth surface of the drum gear. By the restricting face, movement of the cleaning gear in the input direction thereof is restricted.

Therefore, even when a force to rotationally drive the cleaning roller is input from the cleaning gear provided at one end portion of the cleaning roller, the one end portion of the cleaning roller is never moved in the input direction of the force. Accordingly, the cleaning roller can uniformly contact across the axial direction thereof with the photosensitive drum. As a result, extraneous matter on the peripheral surface of the photosensitive drum can be satisfactorily removed across the axial direction of the cleaning roller.

According to the second illustrative aspect of the invention, the photosensitive cartridge includes a cleaning bearing member that is provided in contact with the restricting face. An end portion of the cleaning roller is inserted through the cleaning bearing member in a relatively rotatable manner. That is, the end portion of the cleaning roller is relatively rotatable with the cleaning bearing member. Accordingly, the cleaning gear is restricted, via the cleaning bearing member, in movement in the input direction by the restricting face. Therefore, movement of the cleaning gear can be restricted without obstructing rotation of the cleaning roller.

According to the third illustrative aspect of the invention, the photosensitive cartridge includes a drum bearing member, through which an end portion of the photosensitive drum is inserted in a relatively rotatable manner. The drum bearing member is fitted to the frame from one side. Moreover, the cleaning bearing member includes an inserting part, which is inserted from an opposite side to the one side toward the one side, and an opposing part, which is bent from a front end portion of the inserting part and is opposed to the frame. In addition, the drum bearing member includes an entering part that enters between the frame and the opposing part.

Therefore, movement of the opposing part of the cleaning bearing member to the other side is restricted by the entering part of the drum bearing member. Accordingly, the cleaning bearing member is prevented from coining off from the frame. Further, movement of the entering part of the drum bearing member to one side is restricted by the opposing part of the cleaning bearing member. Accordingly, the drum bearing member is prevented from coming off from the frame. Thus, since the drum bearing member and the cleaning bearing member are mutually prevented from coming off from the frame, it is not necessary to provide members for preventing coming off from the frame on the drum bearing member and the cleaning bearing member, respectively. Therefore, the drum bearing member and the cleaning bearing member can be prevented from coming off from the frame with a simple configuration.

According to the fourth illustrative aspect of the invention, the cleaning bearing member is formed, in a direction along the restricting face, with a smaller width than that of the restricting face. Therefore, the cleaning bearing member is movable along the restricting face. Accordingly, the cleaning roller can uniformly contact across the axial direction thereof with the photosensitive drum, while permitting a movement of the cleaning roller in the direction along the restricting face.

According to the fifth illustrative aspect of the invention, the photosensitive cartridge includes a pressing member for pressing the cleaning roller toward the photosensitive drum. Therefore, the cleaning roller, as a result of receiving a pressing force from the pressing member, makes contact with the peripheral surface of the photosensitive drum in a state moderately pressed thereagainst. As a result, extraneous matter on the peripheral surface of the photosensitive drum can be satisfactorily removed, without rotation of the photosensitive drum being obstructed by contact of the cleaning roller.

According to the sixth illustrative aspect of the invention, the photosensitive cartridge includes a swinging shaft and a pendulum bearing. The swinging shaft uses the swing axis of the cleaning roller as a center axis. The pendulum bearing integrally includes a swinging shaft external fitting part to be externally fitted to the swinging shaft and a cleaning shaft external fitting part to be externally fitted to an end portion of the cleaning roller.

Therefore, the cleaning roller is swingably supported on the swinging shaft via the pendulum bearing. Accordingly, the cleaning roller can be made swingable with a simple configuration.

Exemplary Embodiments

Exemplary embodiments of the invention will now be described with reference to drawings.

(1) Image Forming Apparatus

As shown in FIG. 1, the image forming apparatus 1 includes a body casing 2. Four process cartridges 3 (each of which is one example of a photosensitive member cartridge) are provided in the body casing 2. The process cartridges 3 (3K, 3Y, 3M, 3C) are provided corresponding to each color of black, yellow, magenta, and cyan. The process cartridges 3 are arranged at equal intervals in the order of black, yellow, magenta, and cyan from an upstream side thereof in a conveying direction of a sheet P by a conveyance belt 11 (which will be described later). Each process cartridge 3 can be mounted from above to an interior of the body casing 2 while opening a top cover 4 provided at the upper surface of the body casing 2.

Each process cartridge 3 includes a photosensitive drum 5. Moreover, in each process cartridge 3, a scorotron-type charger 6, a developing roller 7, a cleaning mechanism 8, etc., are provided opposed to the peripheral surface of the photosensitive drum 5.

In the body casing 2, four LED units 9 corresponding to each color are provided corresponding to each process cartridge 3. A front end portion of each LED unit 9 is provided opposed to the peripheral surface of the photosensitive drum 5.

In accordance with rotation of the photosensitive drum 5, the surface of the photosensitive drum 5 is uniformly charged with electricity by the scorotron-type charger 6, and then exposed by LEDs (not shown) provided at the front end portion of the LED unit 9. Accordingly, an electrostatic latent image based on image data is formed on the surface of the photosensitive drum 5. In addition, when the electrostatic latent image is opposed to the developing roller 7 by the rotation of the photosensitive drum 5, developer is supplied to the electrostatic latent image, and a developer image is formed on the surface of the photosensitive drum 5. Incidentally, toner is one example of the developer.

A sheet feeding tray 10 for accommodating sheets P is provided in a bottom portion of the body casing 2. The sheets P accommodated in the sheet feeding tray 10 are conveyed onto the conveyance belt 11 by various rollers. The conveyance belt 11 is provided opposed from below to the four photosensitive drums 5. A transfer roller 12 is provided at each position opposed to each photosensitive drum 5 across an upper part of the conveyance belt 11. The sheets P conveyed onto the conveyance belt 11 sequentially pass through between the conveyance belt 11 and each photosensitive drum 5 due to traveling of the conveyance belt 11. Then, when the developer image on the surface of the photosensitive drum 5 is opposed to the sheet P, the developer image is transferred to the sheet P by a transfer bias applied to the transfer roller 12.

A fixing unit 13 is provided at a downstream side in the conveying direction of the sheet P with respect to the conveyance belt 11. The sheet P transferred with the developer image is conveyed to the fixing unit 13. The fixing unit 13 heats and presses the developer image in order to fix the developer image to the sheet P. The sheet P fixed with the developer image is discharged to a sheet discharge tray 14 at the upper surface of the body casing 2 by various rollers.

After the developer image is transferred from the photosensitive drum 5 to the sheet P, extraneous matter such as residual developer and paper dust of the sheet P adhered on the peripheral surface of the photosensitive drum 5 is, when opposed to the cleaning mechanism 8 as a result of rotation of the photosensitive drum 5, collected by the cleaning mechanism 8.

Incidentally, in the following description, an upstream side in the conveying direction of the sheet P by the conveyance belt 11 is referred to as a front side (front face side), and a downstream side being an opposite side thereof is referred to as a back side (back surface side). In addition, the image forming apparatus 1 viewed from the front side is used as a basis of right and left. In the following, the right-left direction is referred to as a width direction. With regard to the process cartridge 3, description will be given with reference to the illustrated directional arrows unless particularly referred to.

(2) Process Cartridge (2-1) Overall Structure of Process Cartridge

Figure 2:
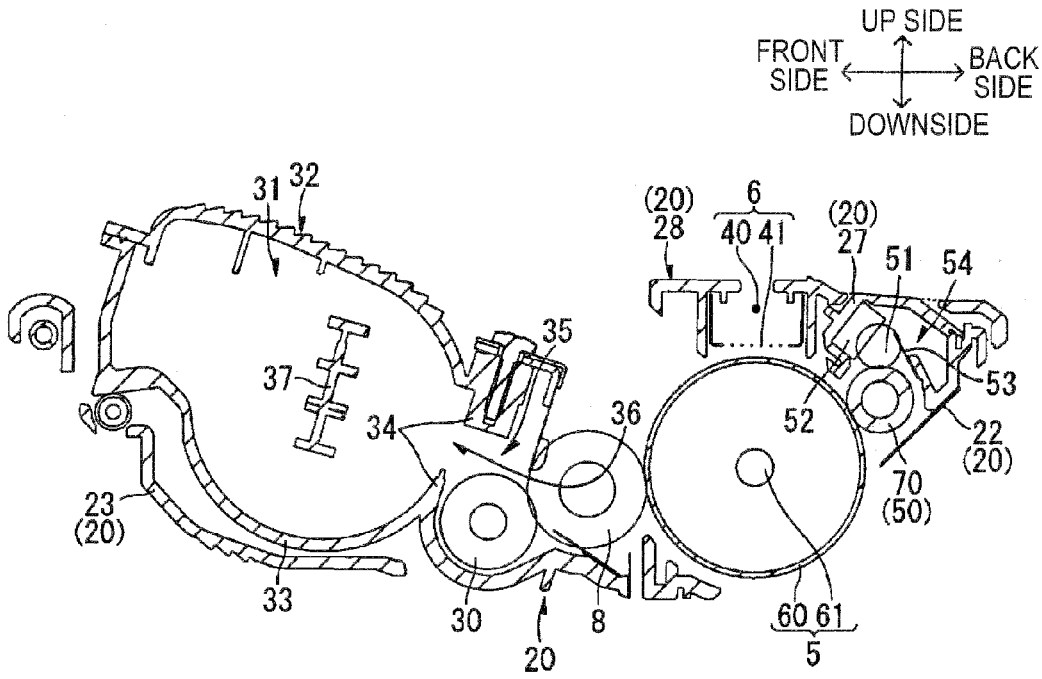
FIG. 2 is a central sectional view of a process cartridge of the image forming apparatus.

Referring to FIG. 2, the process cartridge 3 includes a frame 20, which has a box-like shape, and whose upper surface is open. The frame 20 holds the photosensitive drum 5, the scorotron-type charger 6, the cleaning mechanism 8, etc., therein. Moreover, the frame 20 is detachably attached with a developing cartridge 32. The developing cartridge 32 includes the developing roller 7.

The photosensitive drum 5 includes a drum body 60 and a drum shaft 61.

The drum body 60 has a circular cylindrical shape extending in the width direction. An outermost layer of the drum body 60 is made of a photosensitive layer. The drum shaft 61 extends along the central axis of the drum body 60, and has a columnar shape smaller in diameter than the drum body 60.

As described above, the electrostatic latent image is formed on the surface (outer peripheral surface) of the drum body 60. A part of the surface of the drum body 60 is, with the photosensitive drum 5 being held in the frame 20, exposed toward the lower front side from the frame 20. Accordingly, as shown in FIG. 1, the part exposed from the frame 20 in the drum body 60 is opposed to the transfer roller 12 across the conveyance belt 11 with the process cartridge 3 being attached in the body casing 2.

As shown in FIG. 2, the scorotron-type charger 6 is provided opposed in a spaced manner with respect to the drum body 60 of the photosensitive drum 5 above the photosensitive drum 5. Specifically, the scorotron-type charger 6 includes a discharge wire 40, which is provided opposed to the peripheral surface of the photosensitive drum 5, and a grid 41, which is provided between the discharge wire 40 and the photosensitive drum 5 for controlling the amount of charge to be applied to the photosensitive drum 5 from the discharge wire 40. By applying a high voltage to the discharge wire 40 while simultaneously applying bias to the grid 41 to cause a corona discharge of the discharge wire 40, the surface of the photosensitive drum 5 can be charged.

The cleaning mechanism 8 is provided at an upper back side of the photosensitive drum 5. The cleaning mechanism 8 includes a primary cleaning roller 50 (one example of a cleaning roller), a secondary cleaning roller 51 (one example of a swinging shaft), a scraping member 52, a film 53, and a collecting part 54.

The primary cleaning roller 50 has a circular cylindrical shape extending in the width direction, and has substantially the same width in the width direction as that of the photosensitive drum 5. The central axis of the primary cleaning roller 50 is parallel to the central axis of the photosensitive drum 5. The primary cleaning roller 50 is provided so as to make contact with a back part in the peripheral surface of the photosensitive drum 5 across the width direction.

The secondary cleaning roller 51 has a circular cylindrical shape extending in the width direction, and has substantially the same width in the width direction as that of the primary cleaning roller 50. The central axis of the secondary cleaning roller 51 is parallel to the central axis of the photosensitive drum 5. The secondary cleaning roller 51 is provided so as to make contact with an upper part in the peripheral surface of the primary cleaning roller 50.

The scraping member 52 is, for example, a brush extending along the width direction. The scraping member 52 is supported by the frame 20. The scraping member 52 is provided so as to make contact with an upper front part in the peripheral surface of the secondary cleaning roller 51.

One end portion of the film 53 is fitted to the frame 20. The film 53 includes a free end at the other end portion opposite to the one end portion. The free end of the film 53 is provided so as to make contact with the peripheral surface of the secondary cleaning roller 51.

The space partitioned by the frame 20, the secondary cleaning roller 51, the scraping member 52, and the film 53 serves as the collecting part 54. Extraneous matter collected from the top of the peripheral surface of the photosensitive drum 5 is retained in the collecting part 54. More specifically, extraneous matter collected from the top of the peripheral surface of the photosensitive drum 5 by the primary cleaning roller 50 is passed to the secondary cleaning roller 51 by a rotation of the primary cleaning roller 50, scraped by the scraping member 52, and sent to the collecting part 54 to be retained therein.

The developing cartridge 32 includes a developing casing 33, which has a box shape, and whose back end portion is open. The interior of the developing casing 33 is partitioned into a front and back by a partition 34, which is provided in a midway portion of the front-back direction thereof. Accordingly, a developer hopper 31 and a developing unit 35 provided on the back side of the developer hopper 31 are formed in the developing casing 33. In the partition 34, a communicating hole 36 that communicates the developer hopper 31 with the developing unit 35 is formed.

Developer corresponding to each color is accommodated in the developer hopper 31. An agitator 37 for agitating the developer is rotatably provided in the tonner hopper 31.

The developing roller 7 and a supply roller 30 are provided in the developing unit 35. The supply roller 30 has a circular cylindrical shape extending in the width direction, and is provided in an adjacent manner at the back side of the communicating hole 36 in the developing unit 35. Moreover, the developing roller 7 has a circular cylindrical shape extending in the width direction, and is provided so as to make contact with a back part in the peripheral surface of the supply roller 30. A back part in the peripheral surface of the developing roller 7 is exposed backward from the developing casing 33, and is in contact with a back part in the peripheral surface of the photosensitive drum 5 with the developing cartridge 32 being attached with the frame 20.

The developer accommodated in the developer hopper 31 is supplied to the surface of the supply roller 30 via the communicating hole 36 while being agitated by a rotation of the agitator 37. Then, by a rotation of the supply roller 30 and the developing roller 7, the developer is supplied from the supply roller 30 to the surface of the developing roller 7.

(2-2) Frame

Figure 3:
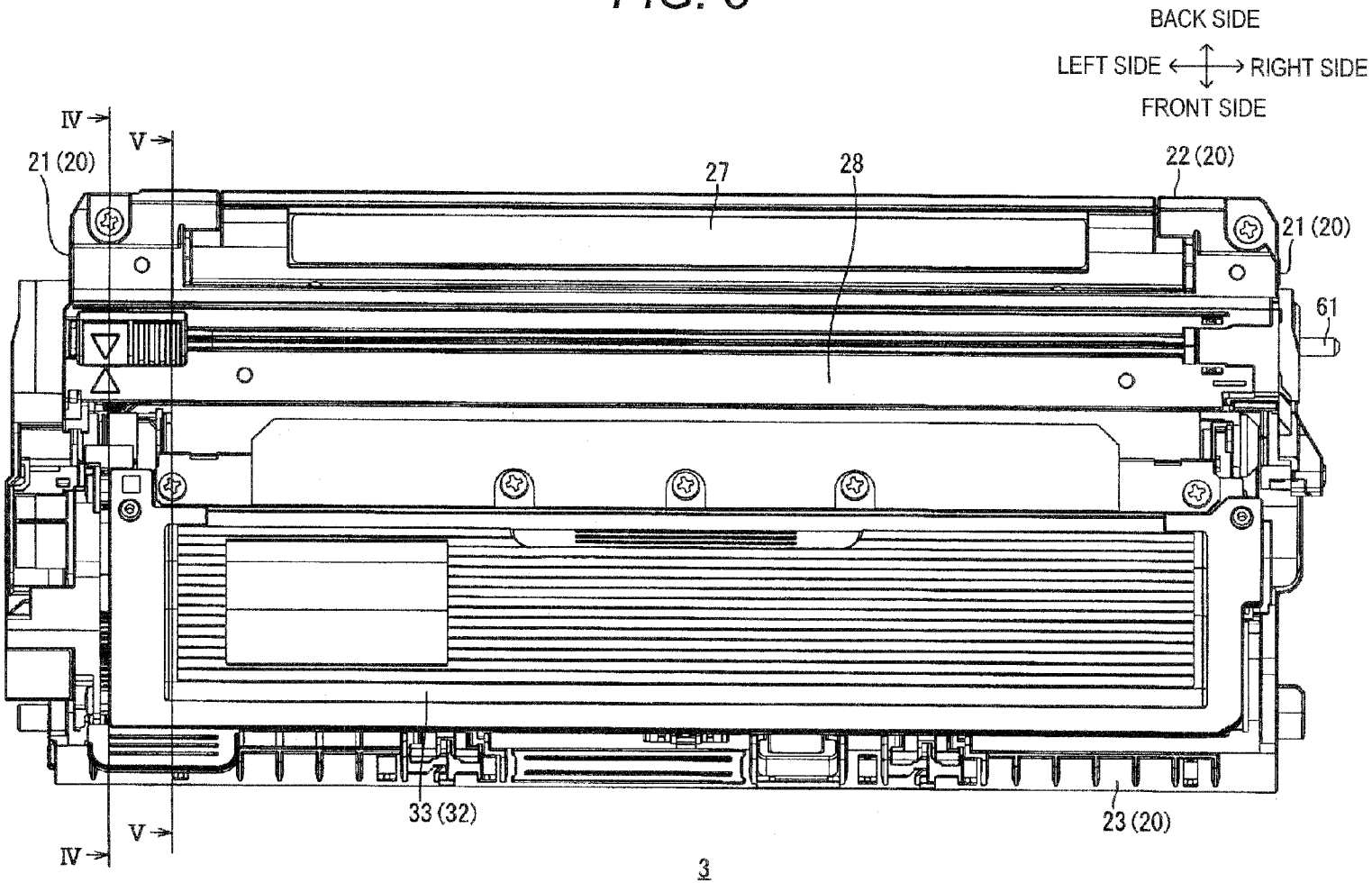
FIG. 3 is a plan view of the process cartridge.

As shown in FIG. 3, the frame 20 includes a pair of right and left side walls 21, a back-side connecting part 22 to which a back part of each side wall 21 is connected, a front-side connecting part 23 to which a front part of each side wall is connected, and a first cover part 27 and a second cover part 28 opposed to the back-side connecting part 22 from above.

Figure 6:
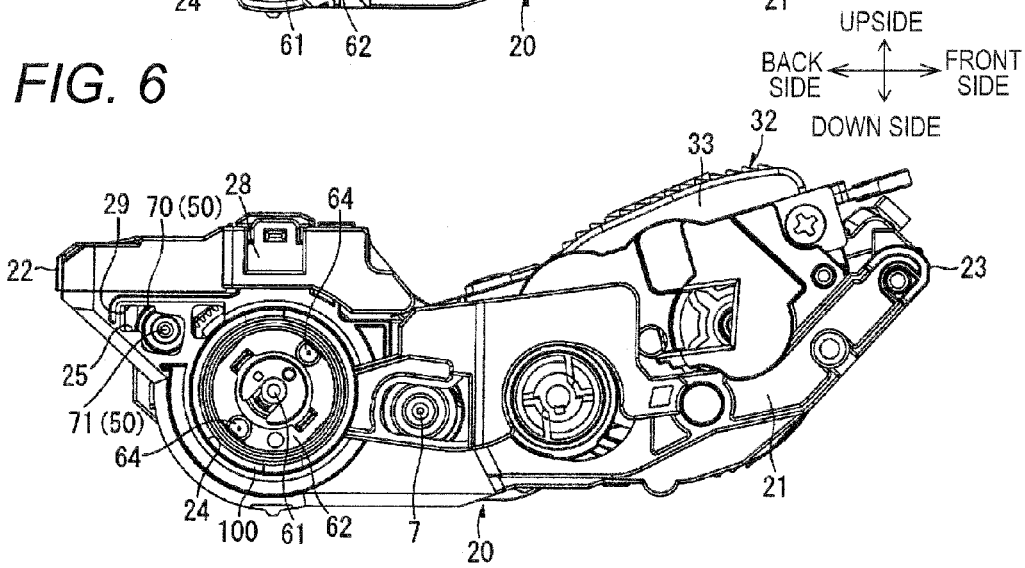
FIG. 6 is a left side view of the process cartridge.

As shown in FIG. 6, the side wall 21 has a substantially rectangular plate shape in a side view extending in the front-back direction. A back end portion of the side wall 21 is inclined at a lower end thereof toward the upper back side. A front end portion of the side wall 21 is inclined at a lower end thereof toward the upper front side. Incidentally, a cleaning bearing member 73 (which will be described later) is omitted in FIG. 6.

A drum hole 24 and a cleaning bearing hole 25 are formed as through-holes in the side wall 21.

The drum hole 24 is formed at the back end portion in the side wall 21, and has a circular shape in a side view. The drum hole 24 is fitted with a drum bearing member 100 having a circular cylindrical shape. The drum bearing member 100 is internally inserted therethrough with an end portion in the width direction of the photosensitive drum 5 (see FIG. 2) so as to be relatively rotatable.

As shown in FIG. 6, the cleaning bearing hole 25 is formed at a position of an upper back side with respect to the drum hole 24. An upper end 29 (one example of a restricting face) of the cleaning bearing hole 25 extends in the front-back direction, and has a crank shape in a side view where a front part thereof is lowered one step from a back part. In addition, a lower end of the cleaning bearing hole 25 extends in the front-back direction, and has a crank shape in a side view where a front part thereof is lowered one step from a back part. The lower end of the cleaning bearing hole 25 is parallel to the upper end thereof. A back end of the cleaning bearing hole 25 extends substantially in the up-down direction to connect the back ends of the upper end 29 and lower end to each other. A front end of the cleaning bearing hole 25 extends substantially in the up-down direction to connect the front ends of the upper end 29 and lower end to each other.

Referring to FIG. 2, a center portion in the width direction of the back-side connecting part 22 is opened upward and is formed into a substantially U-shape in cross section. The film 53 of the cleaning mechanism 8 is fitted to a loose end portion, which is at the front side in the back-side connecting part 22.

The first cover part 27 extends forward from a back-side upper end portion of the back-side connecting part 22, and has a plate shape long in the width direction. The scraping member 52 of the cleaning mechanism 8 is held on the lower surface of the first cover part 27.

The second cover part 28 has a plate shape extending further forward than the first cover part 27. The scorotron-type charger 6 is held on the lower surface of the second cover part 28.

The first cover part 27 and the second cover part 28 are provided to the frame 20. The first cover part 27 and the second cover part 28 are removable from the frame 20.

(2-3) Photosensitive Drum

Figure 7:
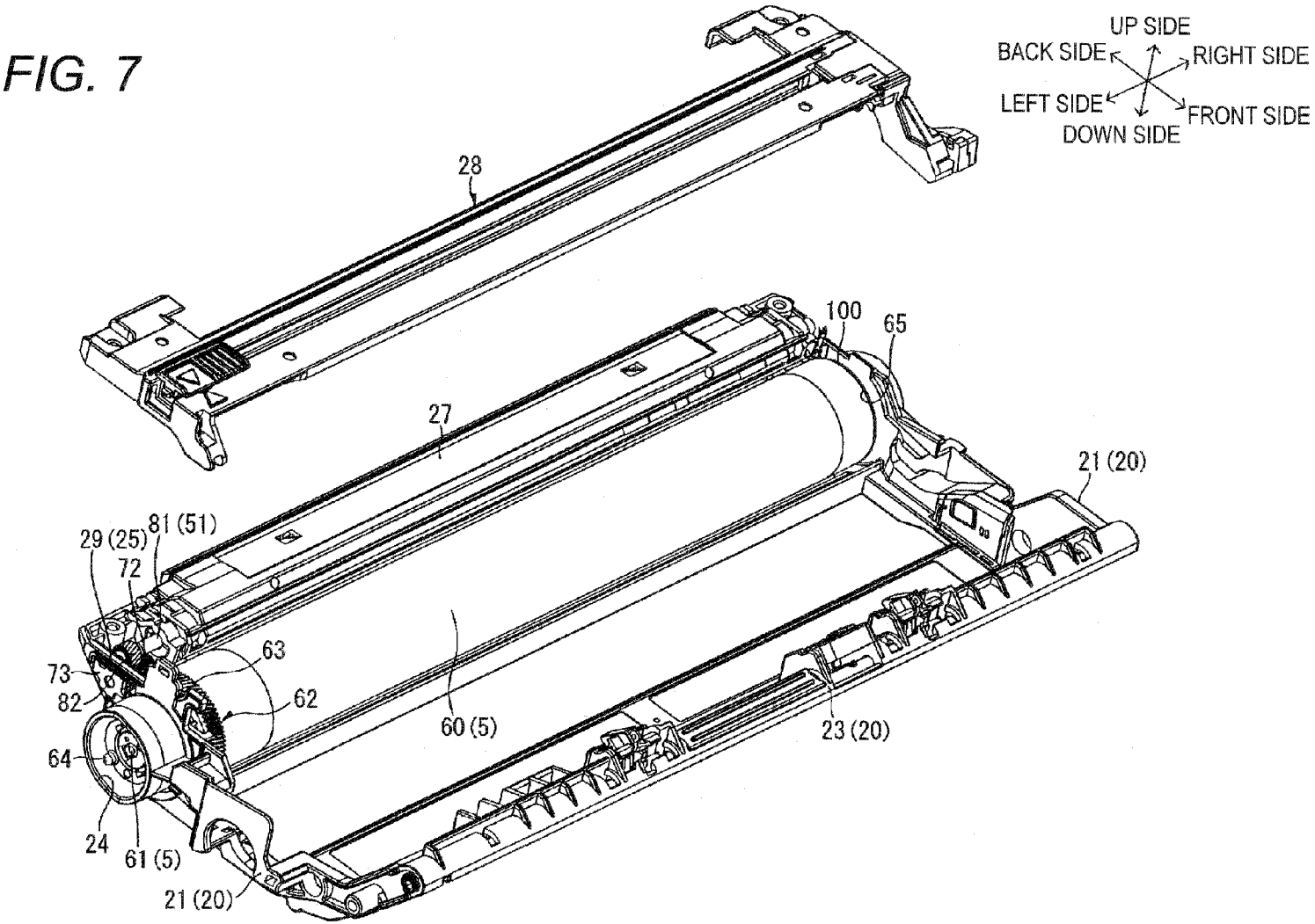
FIG. 7 is a perspective view of the process cartridge as viewed from a front left side, showing a state where the developing cartridge and a second cover part are removed.
Figure 8:
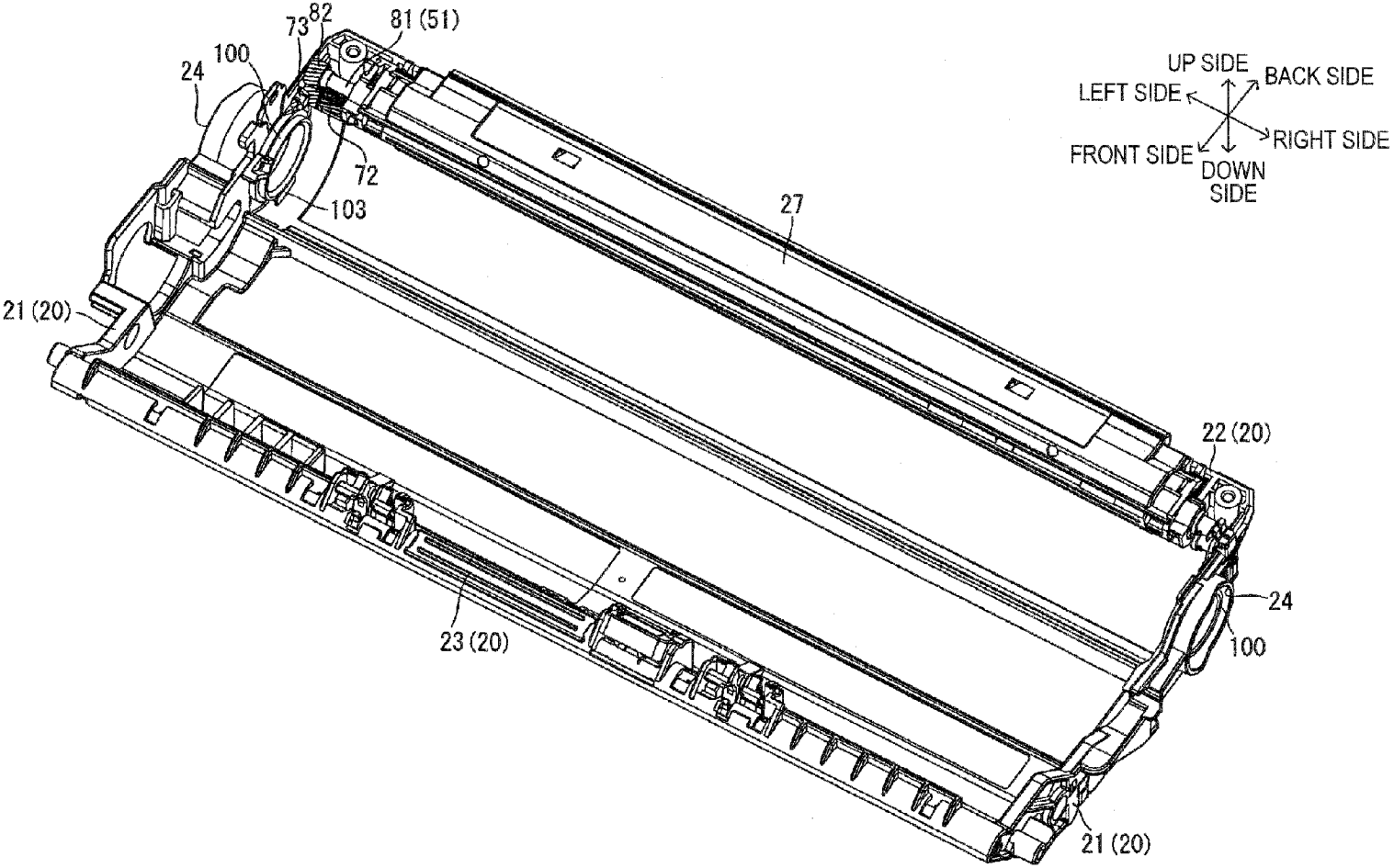
FIG. 8 is another perspective view of the process cartridge as viewed from a front right side, showing a state where the photosensitive drum is removed from the state shown in FIG. 7.

As shown in FIG. 7, at a left end portion of the drum body 60 (left end portion of the photosensitive drum 5), a left flange 62 is fitted so as to be relatively unrotatable with respect to the drum body 60. The left flange 62 has a circular cylindrical shape centered on an identical axis to that of the drum body 60.

At the outside (left side) in the width direction of the left flange 62, a drum gear 63 having gear teeth at an outer peripheral surface thereof is provided integrally with the left flange 62. Moreover, at the outside in the width direction of the drum gear 63, a drive input part 64 having a circular cylindrical outline is formed. Each center axis of the drum gear 63 and the drive input part 64 is coincident with the center axis of the left flange 62.

The drive input part 64 is relatively rotatably inserted through the drum bearing member 100 fitted with the drum hole 24 of the left side wall 21 of the frame 20. The drive input part 64 is coupled with a drive output part (not shown) provided on the body casing 2 (see FIG. 1). A driving force for rotationally driving the photosensitive drum 5 is input from the drive output part.

A right flange 65 is fitted so as to be relatively unrotatable with respect to the drum body 60 at a right end portion of the drum body 60 (right end portion of the photosensitive drum 5). The right flange 65 has a circular cylindrical shape centered on an identical axis to that of the drum body 60.

An inserting part (not shown) is fanned on the outside (right side) in the width direction of the right flange 65. The inserting part includes a circumferential surface as an outer peripheral surface, and a center axis thereof is coincident with the center axis of the right flange 65. The inserting part is relatively rotatably inserted through the drum bearing member 100, which is fitted to the drum hole 24 of the right side wall 21 of the frame 20.

(2-4) Cleaning Mechanism (2-4-1) Primary Cleaning Roller

Figure 12:
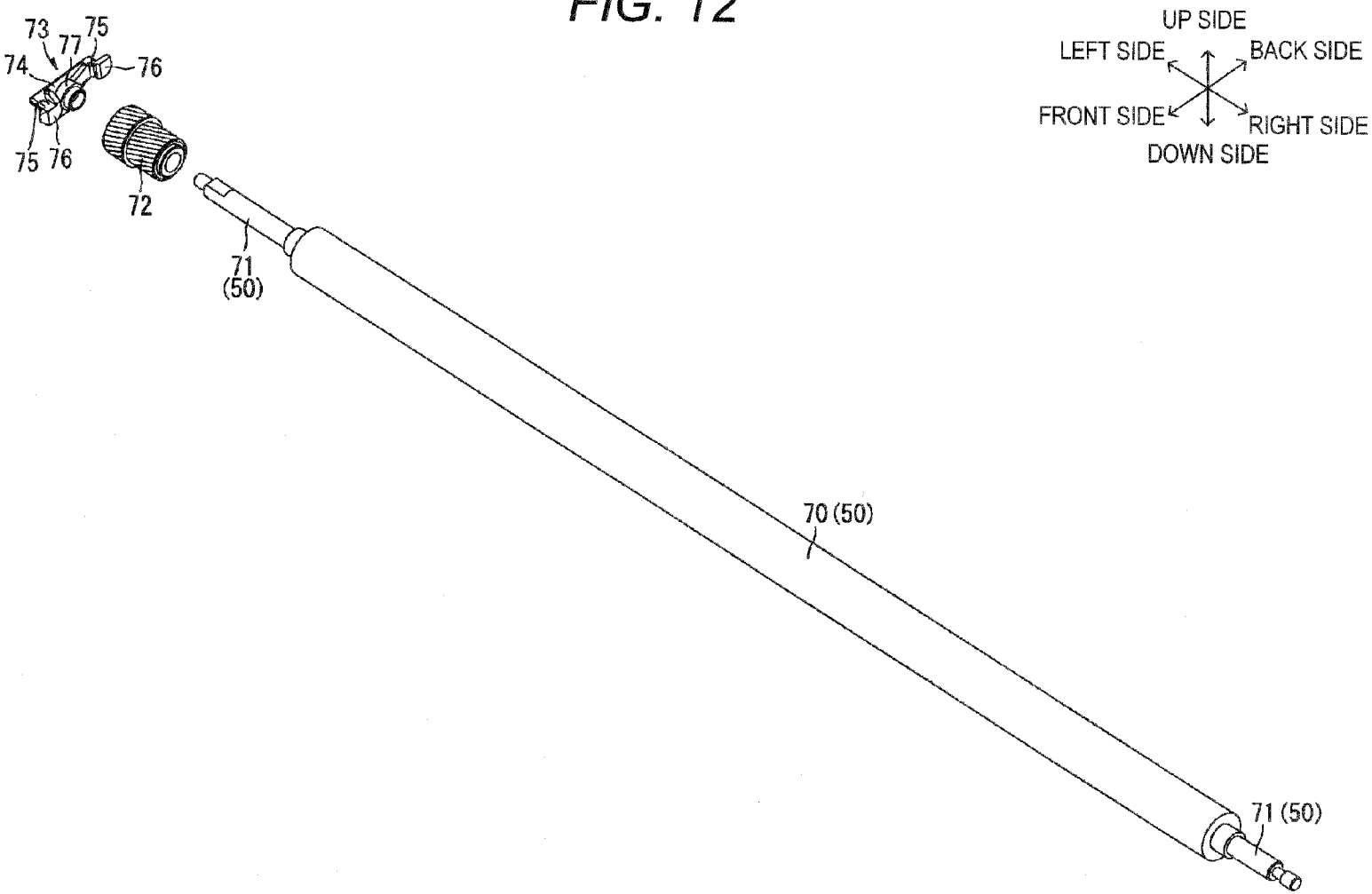
FIG. 12 is a schematic perspective view of the primary cleaning roller as viewed from the front right side.
Figure 13:
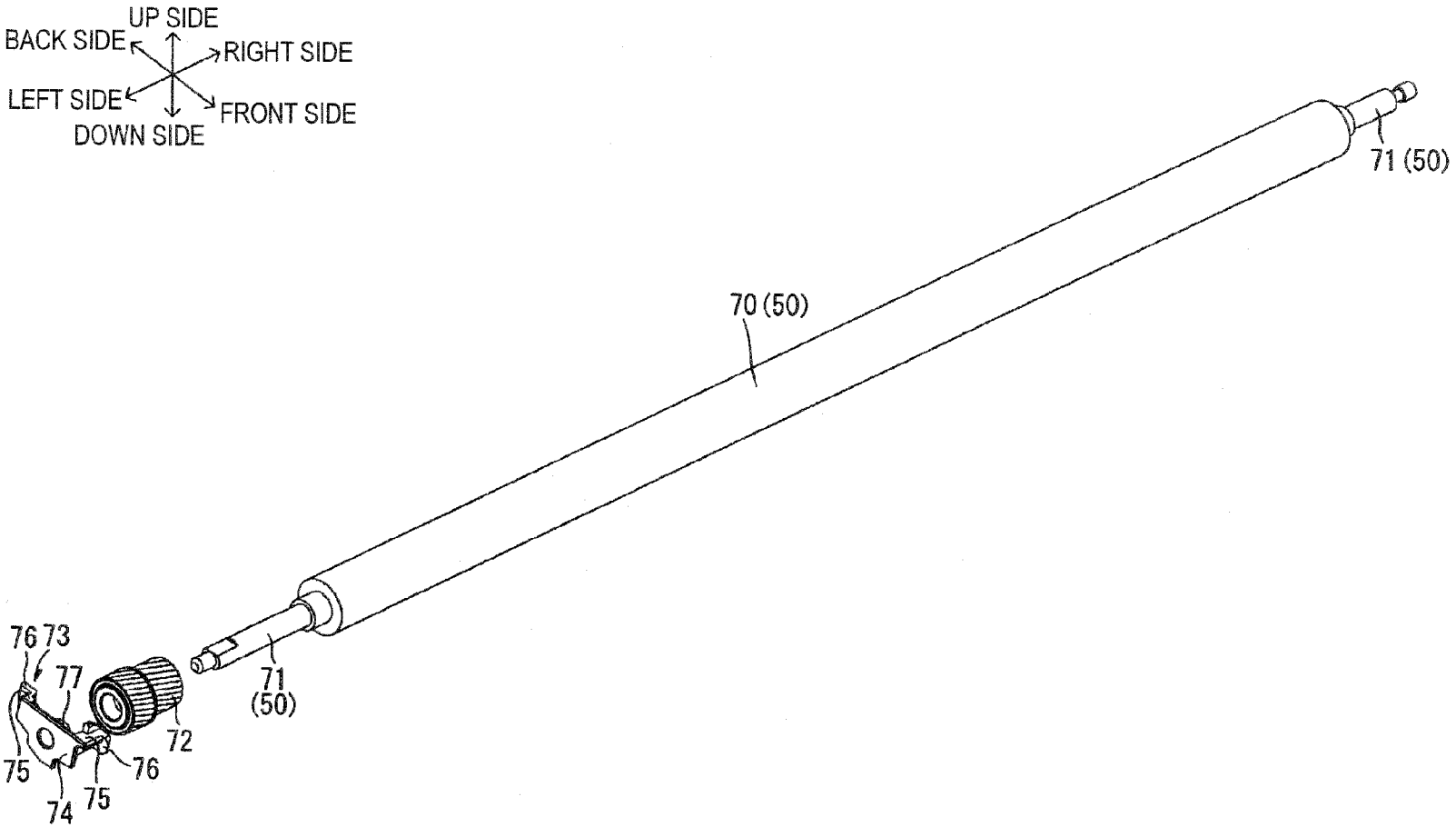
FIG. 13 is another schematic perspective view of the primary cleaning roller as viewed from the front left side.

As shown in FIG. 12 and FIG. 13, the primary cleaning roller 50 includes a primary cleaning body part 70 and a primary cleaning shaft 71.

The primary cleaning body part 70 has, for example, a circular cylindrical shape made of sponge. The rod-like primary cleaning shaft 71 extending in the width direction is inserted through a hollow part of the primary cleaning body part 70.

Figure 10:
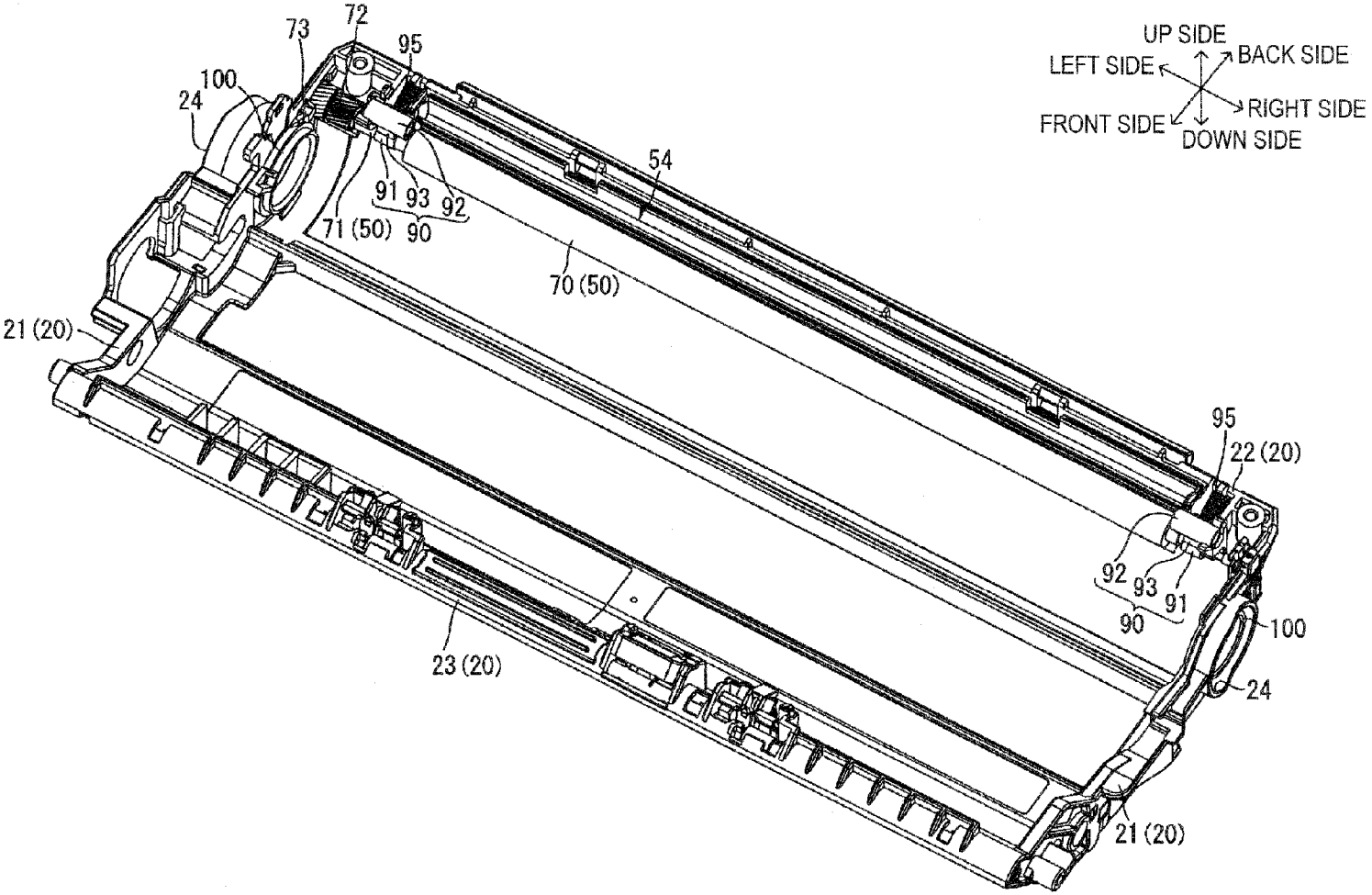
FIG. 10 is yet another perspective view of the process cartridge as viewed from the front right side, showing a state where a secondary cleaning roller is removed from the state shown in FIG. 9.

As shown in FIG. 10, a primary cleaning gear 72 (one example of a cleaning gear) is externally fitted so as to be relatively unrotatable at a position further left than the primary cleaning body part 70 in the primary cleaning shaft 71. Gear teeth are formed on the peripheral surface of the primary cleaning gear 72. The gear teeth are formed at the inside (right side) and the outside (left side), which are for receiving a driving force from the drum gear 63, and for transmitting a driving force to a secondary cleaning roller gear 82 to be described later, respectively.

A cleaning bearing member 73 is fitted at a left end portion of the primary cleaning shaft 71.

As shown in FIG. 12 and FIG. 13, the cleaning bearing member 73 includes a body part 74 extending in the front-back direction, inserting parts 75 extending rightward from both end portions in the front-back direction of the body part 74, an opposing part 76 extending to the outside in the front-back direction from a left end portion of each inserting part 75, and a circular cylindrical supporting part 77 extending rightward from a right side surface of the body part 74.

The body part 74 has a rectangular plate shape extending in the front-back direction and the up-down direction in a side view. The body part 74 has a smaller width in the front-back direction than that of the cleaning bearing hole 25 (see FIG. 6) in the left side wall 21 of the frame 20.

The supporting part 77 is internally inserted with the left end portion of the primary cleaning shaft 71 so as to be relatively rotatable. The supporting part 77 is externally fitted with the primary cleaning gear 72 so as to be relatively rotatable.

(2-4-2) Secondary Cleaning Roller

Figure 9:
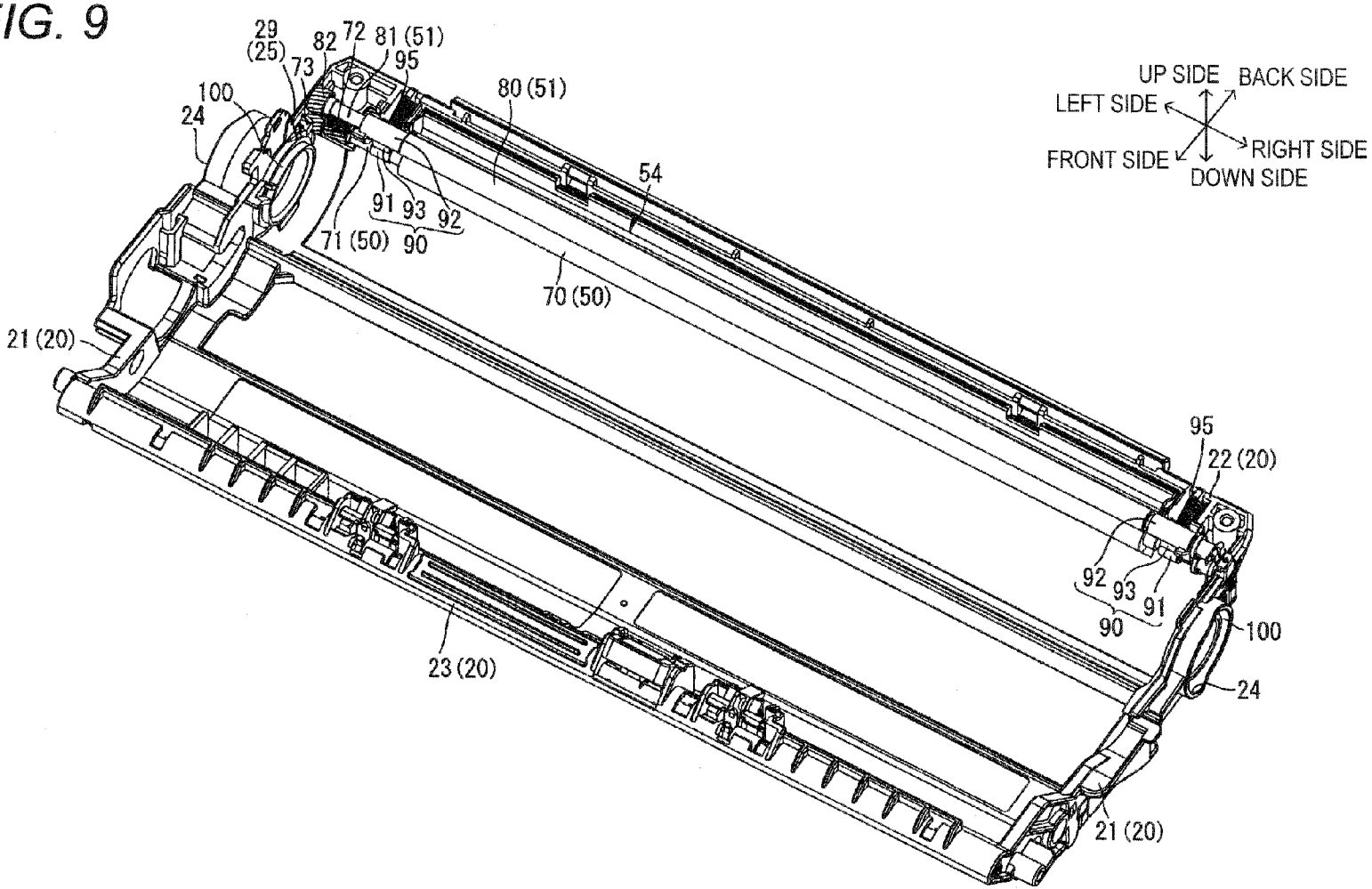
FIG. 9 is yet another perspective view of the process cartridge as viewed from the front right side, showing a state where a first cover part is removed from the state shown in FIG. 8.

As shown in FIG. 9, the secondary cleaning roller 51 includes a secondary cleaning body part 80 and a secondary cleaning shaft 81 projecting from both ends of the secondary cleaning body part 80.

The secondary cleaning body part 80 is made of metal, and has a columnar shape extending in the width direction.

The secondary cleaning shaft 81 has the same center axis as that of the secondary cleaning body part 80, and smaller in outside diameter thereof than the outside diameter of the secondary cleaning body part 80.

A secondary cleaning gear 82 is externally fitted to the secondary cleaning shaft 81 at a position further left than the secondary cleaning body part 80 so as to be relatively unrotatable. Gear teeth are formed on the peripheral surface of the secondary cleaning gear 82.

(2-4-3) Pendulum Bearing

As shown in FIG. 9, the primary cleaning roller 50 and the secondary cleaning roller 51 are connected at both end portions thereof by two pendulum bearings 90.

The pendulum bearing 90 includes a first bearing 91 (one example of a cleaning shaft external fitting part) and a second bearing 92 (one example of a swinging shaft external fitting part). The first bearing 91 has a circular cylindrical shape and is externally fitted to the primary cleaning shaft 71 so as to be relatively rotatable. The second bearing 92 has a circular cylindrical shape and is externally fitted to the secondary cleaning shaft 81 so as to be relatively rotatable. The first bearing 91 and the second bearing 92 are connected by a connecting part 93 interposed therebetween. The first bearing 91, the second bearing 90, and the connecting part 93 are integrally formed.

The first bearing 91 is relatively rotatable with respect to the primary cleaning shaft 71. The second bearing 92 is relatively rotatable with respect to the secondary cleaning shaft 81. Accordingly, the primary cleaning roller 50 is provided so as to be swingable with respect to the secondary cleaning roller 51 while maintaining a relative distance and parallelism to the secondary cleaning roller 51. More specifically, the primary cleaning roller 50 is supported on the frame 20 via the pendulum bearings 90 and the secondary cleaning roller 51 in a state swingable around a rotation axis of the secondary cleaning roller 51.

(2-4-4) Coil Spring

A coil spring 95 (one example of a pressing member) is interposed between each pendulum bearing 90 and the back-side connecting part 22 of the frame 20 in a compressed state.

One end portion of the coil spring 95 is locked at a front surface of the back-side connecting part 22. The other end portion of the coil spring 95 is locked at the first bearing 91 of the pendulum bearing 90. Accordingly, the primary cleaning roller 50 is pressed backward by a pressing force of the coil spring 95.

(3) Fitting of Cleaning Bearing Member

Figure 11:
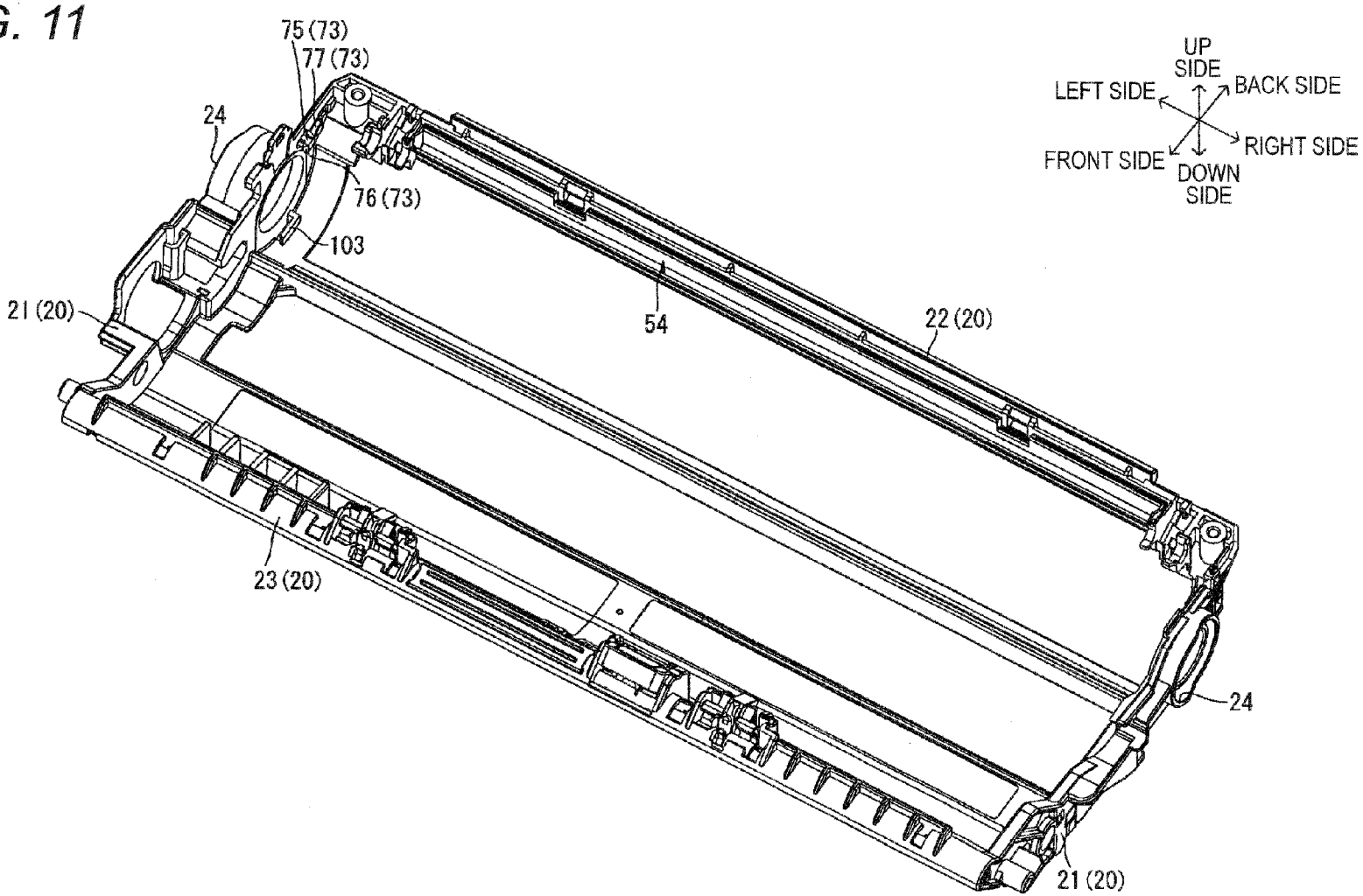
FIG. 11 is yet another perspective view of the process cartridge as viewed from the front right side, showing a state where a primary cleaning roller is removed from the state shown in FIG. 10.

The cleaning bearing member 73 is fitted to the cleaning bearing hole 25 from the outside (left side) in the width direction. Specifically, first, to the cleaning bearing hole 25, the inserting part 75 of the cleaning bearing member 73 is inserted therethrough from the left side of the left side wall 21 of the frame 20. Then, as shown in FIG. 7, the cleaning bearing member 73 is pushed rightward until the upper surface of the body part 74 of the cleaning bearing member 73 makes contact from below with the upper end 29 of the cleaning bearing hole 25. Accordingly, the cleaning bearing member 73 is fitted to the cleaning bearing hole 25. The body part 74 is formed with a width in the front-back direction smaller than that of the cleaning bearing hole 25. Therefore, the cleaning bearing member 73, in a state fitted to the cleaning bearing hole 25, is capable of a sliding movement in the front-back direction. In this state, as shown in FIG. 11, the inserting part 75 of the cleaning bearing member 73 has a front end portion (right end portion) provided at a right side further than the left side wall 21. In addition, the opposing part 76 is provided so as to be opposed to the left side wall 21 of the frame 20 from the right side.

(4) Drum Bearing Member

Figure 14:
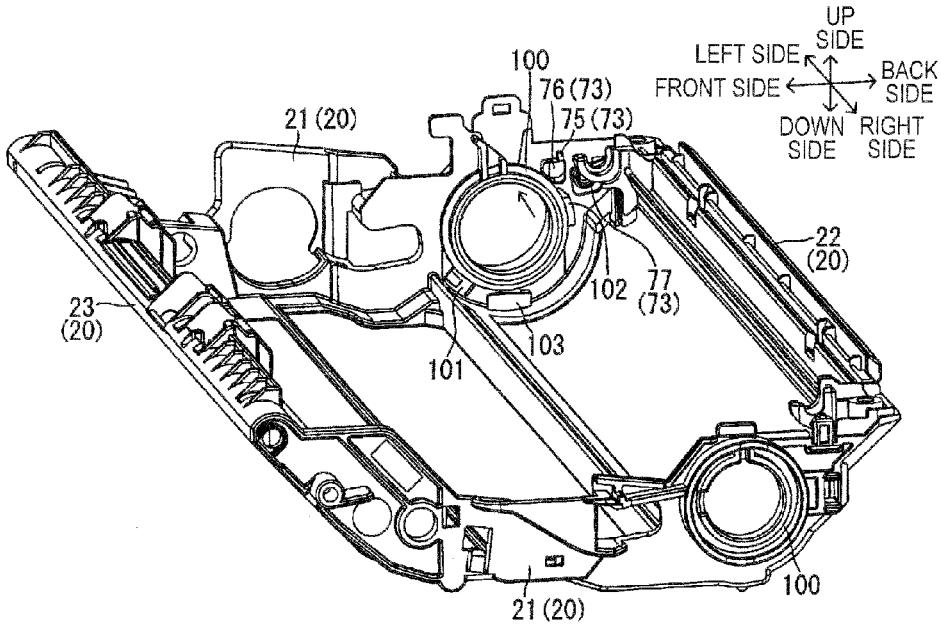
FIG. 14 is a perspective view of a frame as viewed from the front right side, showing a state where a drum bearing member is being fitted.
Figure 15:
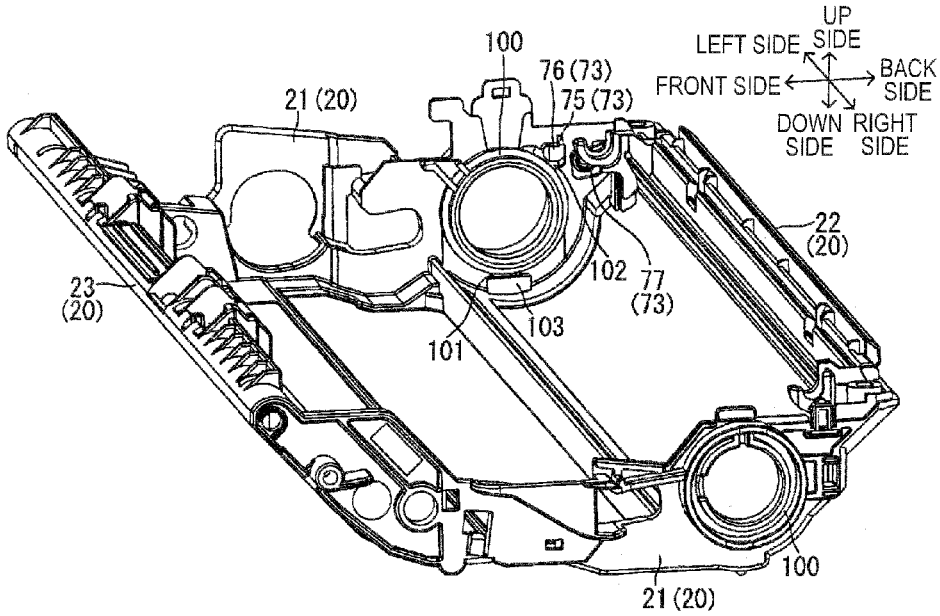
FIG. 15 is a perspective view of a frame as viewed from the front right side, showing a state where the drum bearing member and a cleaning bearing member are fitted.

As shown in FIG. 14 and FIG. 15, the drum bearing member 100 has a circular cylindrical shape long in the width direction, has an outer diameter smaller than the drum hole 24 formed in each side wall 21 of the frame 20, and has an inner diameter larger than the left flange 62 and the right flange 65 (see FIG. 7) of the photosensitive drum 5.

The drum bearing member 100 on the left side includes a fixing part 101 and an entering part 102 extending from a right end thereof in a direction perpendicular to the axial direction. The fixing part 101 and the entering part 102 each have a rectangular plate shape in a side view. The fixing part 101 is provided at a position of a lower side of the drum hole 24 while the drum bearing member 100 is fitted to the drum hole 24. The entering part 102 is provided at a position of an upper back side of the drum hole 24 while the drum bearing member 100 is fitted to the drum hole 24.

On the inner surface (right side surface) of the left side wall 21 of the frame 20, a receiving part 103 is provided below the drum hole 24. The receiving part 103 extends rightward from the inner surface of the side wall 21, and shows a substantially L-shape in a plan view bent at a front end part thereof to extend forward.

After the cleaning bearing member 73 is fitted to the cleaning bearing hole 25 (see FIG. 6), the drum bearing member 100 is fitted to the drum hole 24.

First, from the inside in the width direction with respect to the side wall 21 of the frame 20, the drum bearing member 100 is inserted through the drum hole 24. At this time, the rotational position of the drum bearing member 100 is regulated so that the fixing part 101 is provided at a front side further than the receiving part 103 and the entering part 102 is provided at a lower side further than the opposing part 76 of the cleaning bearing member 73. Then, the drum bearing member 100 is pushed to the outside in the width direction until the fixing part 101 and the entering part 102 make contact with the side wall 21. Thereafter, the drum bearing member 100 is rotated counterclockwise, when viewed from the inside in the width direction (shown by an arrow in FIG. 14).

By the rotation of the drum bearing member 100, the fixing part 101 of the drum bearing member 100 is received between the receiving part 103 and the side wall 21. Then, when the fixing part 101 makes contact with the receiving part 103, a further rotation of the drum bearing member 100 (rotation in the counterclockwise direction) is restricted. In this state, the entering part 102 of the drum bearing member 100 enters between the opposing part 76 of the cleaning bearing member 73 and the side wall 21 of the frame 20. Therefore, the drum bearing member 100 is restricted by the opposing part 76 in movement to the inside in the width direction. Accordingly, the drum bearing member 100 is prevented from coming off from the frame 20.

The entering part 102 of the drum bearing member 100 is provided at the outside in the width direction further than the opposing part 76 of the cleaning bearing member 73. Therefore, movement of the cleaning bearing member 73 to the outside in the width direction is restricted. As a result, the frame 20 of the cleaning bearing member 73 can be prevented from coming off from the cleaning bearing hole 25.

The drum bearing member 100 on the right side has a structure, in which the entering part 102 is omitted from the left drum bearing member 100. A receiving part (not shown) having a structure which is bilaterally symmetrical with the left receiving part 103 is formed on the inner surface (left side surface) of the right side wall 21 of the frame 20. The right drum bearing member 100 is fitted to the right side wall 21 in the same manner as the fitting of the left drum bearing member 100.

(5) Drive of Primary Cleaning Roller

As shown in FIG. 9, the primary cleaning roller 50 is bridged between the side walls 21 of the frame 20 via the cleaning bearing member 73. In this state, the primary cleaning roller 50 is pressed forward by the coil spring 95. Accordingly, as shown in FIG. 2, the primary cleaning body part 70 is brought into contact with the upper back part in the peripheral surface of the drum body 60 of the photosensitive drum 5. Moreover, as shown in FIG. 4, the primary cleaning gear 72 meshes with the drum gear 63 of the photosensitive drum 5 from the upper back side.

Figure 4:
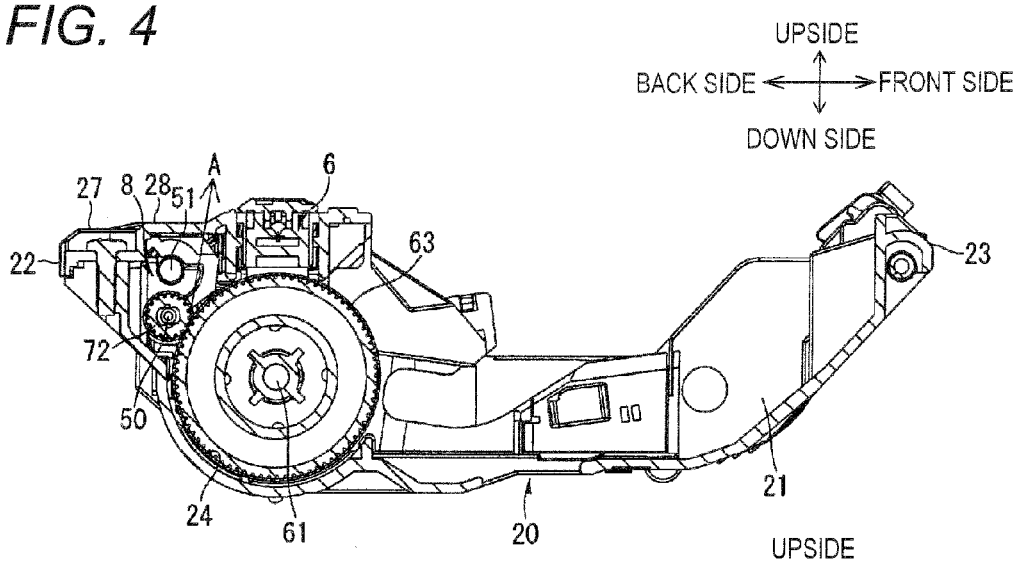
FIG. 4 is a sectional view of the process cartridge taken along a line IV-IV in FIG. 3, showing a state where a developing cartridge is removed.
Figure 5:
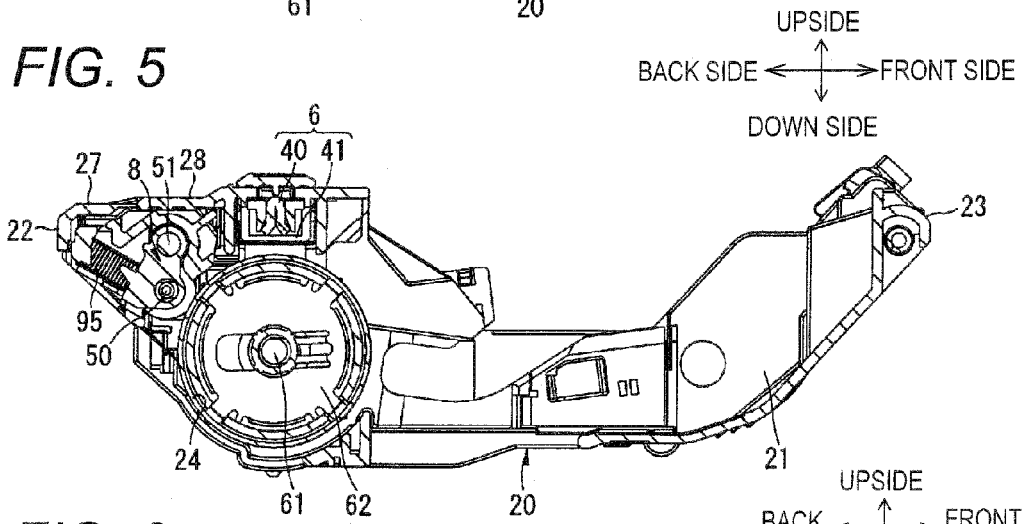
FIG. 5 is another sectional view of the process cartridge taken along a line V-V in FIG. 3, showing a state where the developing cartridge is removed.

When the photosensitive drum 5 is input with a driving force, the photosensitive drum 5 is rotated in the clockwise direction of FIG. 4. In accordance with the rotation of the photosensitive drum 5, a rotational driving force is transmitted from the drum gear 63 to the primary cleaning gear 72. Accordingly, the primary cleaning roller 50 is rotationally driven in the counterclockwise direction of FIG. 4 such that a contact part of the primary cleaning roller 50 contacting with the peripheral surface of the photosensitive drum 5 moves in the same direction as the moving direction of the peripheral surface of the photosensitive drum 5.

When the rotational driving force is transmitted from the drum gear 63 to the primary cleaning gear 72, a force is input to a tooth surface of the primary cleaning gear 72 from a tooth surface of the drum gear 63 in an input direction A at a position where the drum gear 63 and the primary cleaning gear 72 are meshed (see FIG. 4). The force acts on the left end portion of the cleaning roller 50 so as to move the left end portion of the cleaning roller 50 in the input direction A. The input direction A of the force is directed substantially upward, and is substantially perpendicular to the upper end 29 (see FIG. 7) of the cleaning bearing hole 25. In other words, the upper end 29 of the cleaning bearing hole 25 extends in a direction perpendicular to the input direction A of a force that the tooth surface of the primary cleaning gear 72 receives from the tooth surface of the drum gear 63.

The upper surface of the body part 74 of the cleaning bearing member 73 is in contact with the upper end 29 of the cleaning bearing hole 25 from below. Therefore, even when such a force as to be moved in the input direction A is applied to the left end portion of the primary cleaning roller 50, an upward movement thereof is restricted by the upper end 29.

Moreover, as shown in FIG. 4, the secondary cleaning roller 51 is provided at the back side (that is, opposite side to the photosensitive drum 5) with respect to the input direction A of a force that the tooth surface of the primary cleaning gear 72 receives from the tooth surface of the drum gear 63 through a meshing position between the primary cleaning gear 72 of the primary cleaning roller 50 and the drum gear 63 of the photosensitive drum 5. As shown in FIG. 9, the secondary cleaning gear 82 provided at the left end portion of the secondary cleaning roller 51 meshes with the primary cleaning gear 72. Therefore, when the primary cleaning roller 50 is rotationally driven, a rotational driving force is transmitted from the primary cleaning gear 72 to the secondary cleaning gear 82. Accordingly, the secondary cleaning roller 51 is rotationally driven so that a contact part thereof with the peripheral surface of the primary cleaning roller 50 moves in the same direction as the moving direction of the peripheral surface of the primary cleaning roller 50.

As described above, according to the exemplary embodiments of the invention, even when a force to rotationally drive the primary cleaning roller 50 is input from the primary cleaning gear 72 provided at the left end portion of the primary cleaning roller 50, the left end portion of the primary cleaning roller 50 is not moved in the input direction A of the force, and thus the primary cleaning roller 50 can uniformly contact across the width direction thereof with the photosensitive drum 5. As a result, extraneous matter on the peripheral surface of the photosensitive drum 5 can be satisfactorily removed across the width direction of the primary cleaning roller 50.

Further, movement of the primary cleaning roller 50 in the input direction A via the cleaning bearing member 73 can be restricted by the upper end 29 of the cleaning bearing hole 25. Accordingly, movement of the primary cleaning gear 72 can be restricted without obstructing rotation of the primary cleaning roller 50.

Still further, the drum bearing member 100 and the cleaning bearing member 73 are mutually prevented from coming off from the frame 20. Therefore, it is not necessary to provide members for preventing coming off from the frame 20 on the drum bearing member 100 and the cleaning bearing member 73, respectively. Accordingly, coming off of the drum bearing member 100 and the cleaning bearing member 73 from the frame 20 can be prevented with a simple configuration.

Still further, the cleaning bearing member 73 is formed with a smaller width than that of the upper end 29 of the cleaning bearing hole 25 in the direction (front-back direction) along the upper end 29 of the cleaning bearing hole 25. Therefore, the cleaning bearing member 73 is movable along the upper end 29 of the cleaning bearing hole 25. Accordingly, the primary cleaning roller 50 can uniformly contact across the width direction thereof with the photosensitive drum 5, while permitting a movement of the primary cleaning roller 50 in the direction along the upper end 29 of the cleaning bearing hole 25.

Still further, the primary cleaning roller 50 makes contact with the peripheral surface of the photosensitive drum 5 in a state moderately pressed thereagainst when the primary clearing roller receives a pressing force from the coil spring 95. As a result, extraneous matter on the peripheral surface of the photosensitive drum 5 can be satisfactorily removed without obstructing rotation of the photosensitive drum 5 by contact of the primary cleaning roller 50.

What is claimed is:

1. A photosensitive cartridge comprising:

a frame;

a photosensitive drum that is rotatably supported on the frame;

a drum gear, which is provided at one end portion of the photosensitive drum, and which rotates integrally with the photosensitive drum;

a first cleaning roller, a peripheral surface of which contacts a peripheral surface of the photosensitive drum to remove extraneous matter on the peripheral surface of the photosensitive drum;

a second cleaning roller contactable with the peripheral surface of the first cleaning roller, wherein a second cleaning roller shaft is parallel to a center axis of the photosensitive drum and a first cleaning roller shaft;

a cleaning gear, which is provided at one end portion of the first cleaning roller, which meshes with the drum gear, and which rotates integrally with the first cleaning roller by a rotational driving force from the drum gear; and a pendulum bearing that integrally comprises:

a first external fitting part that is externally fitted to the first cleaning roller shaft; and a second external fitting part that is externally fitted to the second cleaning roller shaft, wherein the first cleaning roller is swingable around the second cleaning roller shaft with maintaining a relative distance and parallelism to the second cleaning roller shaft by the pendulum bearing, the second cleaning roller shaft being a swing axis of the first cleaning roller, wherein the swing axis is provided at a side that is opposite to the photosensitive drum with respect to a straight line, the straight line extending in an input direction of a force, which is input to a tooth surface of the cleaning gear from a tooth surface of the drum gear, through a meshing position between the cleaning gear and the drum gear, and wherein the frame comprises a restricting face that extends in a direction substantially perpendicular to the input direction so as to restrict movement of the first cleaning roller in the input direction while allowing movement of the first cleaning roller in the direction substantially perpendicular to the input direction.

2. The photosensitive cartridge according to claim 1, further comprising:

a cleaning bearing member, which contacts with the restricting face, and through which an end portion of the cleaning roller is inserted in a relatively rotatable manner.

3. The photosensitive cartridge according to claim 2, further comprising:

a drum bearing member, which is mounted to the frame from one side, and through which an end portion of the photosensitive drum is inserted in a relatively rotatable manner, wherein the cleaning bearing member comprises:

an inserting part, which is inserted from an opposite side to the one side toward the one side with respect to the frame; and an opposing part, which is bent from a front end portion of the inserting part, and which is opposed to the frame, and wherein the drum bearing member comprises an entering part that enters between the frame and the opposing part.

4. The photosensitive cartridge according to claim 2, wherein a width of the cleaning bearing member is smaller than that of the restricting face in a direction along the restricting face.

5. The photosensitive cartridge according to claim 1, further comprising:

a pressing member that presses the cleaning roller toward the photosensitive drum.

6. An image forming apparatus comprising:

a photosensitive cartridge comprising:

a frame;

a photosensitive drum that is rotatably supported on the frame;

a drum gear, which is provided at one end portion of the photosensitive drum, and which rotates integrally with the photosensitive drum;

a first cleaning roller, a peripheral surface of which contacts a peripheral surface of the photosensitive drum to remove extraneous matter on the peripheral surface of the photosensitive drum;

a second cleaning roller contactable with the peripheral surface of the first cleaning roller, wherein a second cleaning roller shaft is parallel to a center axis of the photosensitive drum and a first cleaning roller shaft;

a cleaning gear, which is provided at one end portion of the first cleaning roller, which meshes with the drum gear, and which rotates integrally with the first cleaning roller by a rotational driving force from the drum gear; and a pendulum bearing that integrally comprises:

a first external fitting part that is externally fitted to the first cleaning roller shaft; and a second external fitting part that is externally fitted to the second cleaning roller shaft, wherein the first cleaning roller is swingable around the second cleaning roller shaft with maintaining a relative distance and parallelism to the second cleaning roller shaft by the pendulum bearing, the second cleaning roller shaft being a swing axis of the first cleaning roller, wherein the swing axis is provided at a side that is opposite to the photosensitive drum with respect to a straight line, the straight line extending in an input direction of a force, which is input to a tooth surface of the cleaning gear from a tooth surface of the drum gear, through a meshing position between the cleaning gear and the drum gear, and wherein the frame comprises a restricting face that extends in a direction substantially perpendicular to the input direction so as to restrict movement of the first cleaning roller in the input direction while allowing movement of the first cleaning roller in the direction substantially perpendicular to the input direction.

* * * * *